US005764213A

United States Patent [19]

Tanaka et al.

[11] Patent Number: 5,764,213

[45] Date of Patent: Jun. 9, 1998

[54] LIQUID CRYSTAL DISPLAY APPARATUS

[75] Inventors: Toshihiko Tanaka; Shoji Iwasaki; Norimitsu Kobayashi, all of Tottori-ken, Japan

[73] Assignees: Sanyo Electric Co., Ltd., Osaka-fu; Tottori Sanyo Electric Co., Ltd., Tottori-ken, both of Japan

[21] Appl. No.: 866,445

[22] Filed: May 30, 1997

Related U.S. Application Data

[63] Continuation of Ser. No. 216,893, Mar. 23, 1994, abandoned.

[30] Foreign Application Priority Data

| | | | |
|---|---|---|---|
| Mar. 23, 1993 | [JP] | Japan | 5-064017 |
| Apr. 27, 1993 | [JP] | Japan | 5-101048 |
| May 21, 1993 | [JP] | Japan | 5-119998 |

[51] Int. Cl.[6] ..... G09G 3/36

[52] U.S. Cl. ..... 345/100; 345/94; 345/98

[58] Field of Search ..... 345/94, 95, 96, 345/97, 98, 99, 100, 87, 88, 89, 103, 208, 209, 210; 349/33, 34, 36, 37

[56] References Cited

U.S. PATENT DOCUMENTS

| | | | |
|---|---|---|---|
| 4,795,239 | 1/1989 | Yamashita et al. | 345/96 |
| 5,168,270 | 12/1992 | Masumori et al. | 348/790 |
| 5,170,158 | 12/1992 | Shinya | 345/98 |
| 5,481,651 | 1/1996 | Herold | 345/94 |

FOREIGN PATENT DOCUMENTS

| | | |
|---|---|---|
| A-0507061 | 10/1992 | European Pat. Off. . |
| A-0569974 | 11/1993 | European Pat. Off. . |
| 0 522 510 A2 | 7/1992 | Japan . |
| 5-100642 | 4/1993 | Japan . |
| A-645473 | 9/1984 | Switzerland . |

*Primary Examiner*—Xiao Wu
*Attorney, Agent, or Firm*—Darby & Darby

[57] ABSTRACT

A liquid crystal display apparatus includes an LCD having a plurality (N) of row electrodes and a plurality (M) of column electrodes which intersect to each other orthogonally. A plurality (n) of row electrodes of the plurality (N) of row electrodes are individually and simultaneously driven by a plurality (n) of row drivers with voltages which are determined according to Walsh functions. A VGA controller which receives a video signal outputs display data of one frame. A plurality (n) of storages individually store the display data of each of n rows which are simultaneously driven. The display data from respective storages are applied to a plurality (m) of calculation circuits. Respective calculation circuits calculate driving voltage values for respective column electrodes in accordance with the Walsh function and the display data so as to apply the same to a plurality (m) of column drivers, respectively. Respective column drivers drive the column electrodes included in each of a plurality (m) column electrode groups with the driving voltage values.

12 Claims, 9 Drawing Sheets

LIQUID CRYSTAL DISPLAY APPARATUS

This is a continuation of application Ser. No. 08/216,893, filed Mar. 23, 1994, now abandoned.

BACKGROUND OF THE INVENTION

1. Field of the Invention

The present invention relates to a liquid crystal display apparatus. More specifically, the present invention relates to a liquid crystal display apparatus according to an improved simple matrix drive system (hereinafter, called as "new simple matrix drive system") wherein a plurality of row are simultaneously scanned or driven.

2. Description of the Prior Art

In a conventional simple matrix drive system respective row lines or electrodes of an LCD (liquid crystal display) are driven in a time-division manner. Therefore, in the conventional simple matrix drive system, when the number of time-division, i.e. the number or rows is large, a lag of response, a drop of contrast, and a ghost become problems.

In order to solve disadvantages of the conventional simple matrix drive system, a novel drive system called as a new simple matrix drive system has been proposed in, for example, U.S. patent application Ser. No. 07/678,736 which was filed on Apr. 1, 1991 (This is corresponding to Japanese Patent Laying-Open Gazette No. 5-100642 laid open on Apr. 23, 1993). In the new simple matrix drive system, in order to implement a high-contrast by utilizing a orthonormal matrix, an optimum on/off ratio of a voltage is obtained in accordance with a proper function such as Walsh function.

In such the new simple matrix drive system, since the voltages of pixels must be calculated at every one frame, it is necessary to utilize a dedicated microcomputer or DSP (digital signal processor). In a case of a large-sized LCD, that is, in a case where the number of pixels is large, a microcomputer or DSP having a rapid calculation speed is to be utilized, and therefore, a liquid crystal display apparatus becomes expensive.

SUMMARY OF THE INVENTION

Therefore, a principal object of the present invention is to provide a novel liquid crystal display apparatus according to the new simple matrix driver system.

Another object of the present invention is to provide a cheap liquid crystal display apparatus according to the new simple matrix drive system.

Another object of the present invention is to provide a liquid crystal display apparatus according to the new simple matrix drive system, in which a rapid calculation speed is not required.

Another object of the present invention is to provide a liquid crystal display apparatus according to the new simple matrix drive system, with a good display quality.

A liquid crystal display apparatus according to the present invention utilizes an LCD having a plurality (N) or row electrodes and a plurality (M) of column electrodes which intersect to each other orthogonally, N and M being integers. The liquid crystal display apparatus comprises: row driver means for individually and simultaneously driving a plurality (n) of row electrodes of the plurality (N) of row electrodes with voltages according to a predetermined function, n being less than N; display data outputting means for outputting display data; a plurality (n) of storages for individually storing display data of respective ones of rows which are corresponding to the plurality (n) of row electrodes being driven simultaneously; and column driver means for driving the plurality (M) of column electrodes in accordance with the display data outputted from the plurality (n) of storages and the predetermined function.

In the present invention, the display data of one frame, for example, which is outputted from a VGA controller, for example, is divided and stored in the plurality (n) of storages, and the column driver means determines column electrodes driving voltages on the base of the display data outputted from the respective storages for each row. Therefore, in comparison with the aforementioned prior art in which the display data are collectively applied to the dedicated calculation circuit which calculates driving voltages for the column electrodes for each row on the basis of the display data, a burden of the calculation circuit included in the column driver means becomes very small. Therefore, in accordance with the present invention, it is possible to utilize a calculation circuit having a slow processing speed, and therefore, a liquid crystal display apparatus becomes cheap as a whole.

Furthermore, in one aspect according to the present invention, the column driver means includes a plurality (m) of column drivers for simultaneously driving the plurality (M) of column electrodes in cooperation with each other, m being less than M; and a plurality (m) of calculation circuits which receive the display data from the plurality (n) of storages, and respective calculation circuits calculate voltage values for driving the column electrodes according to the display data and the predetermined function, and applies the voltage values to corresponding ones of the column drivers. In this aspect, since the calculation circuits for calculating the voltage values for the plurality of column drivers which individually drives the column electrodes of the column electrode groups are individually provided, it is not required for the calculation circuits rapid calculation speeds even if the number of pixels, i.e. the number of columns becomes large. Therefore, it is possible to utilize a dedicated calculation device having a calculation speed that is not so rapid, and therefore, it is possible to make the liquid crystal display apparatus cheap as a whole.

In another aspect according to the present invention, a liquid crystal display apparatus utilizes an LCD having a plurality of row electrodes and a plurality of column electrodes which intersect to each other orthogonally, and comprises: function outputting means for outputting different functions at a predetermined interval; row driver means for driving the plurality of row electrodes in accordance with the different functions which are outputted from the function outputting means at the predetermined interval; and column driver means for driving the plurality of column electrodes in accordance with display data and the different functions which are outputted from the function outputting means at the predetermined interval. In this aspect, since fundamental frequencies of driving voltages for respective row electrodes are not fixed, and therefore, a drop of contrast due to a difference between the fundamental frequencies of adjacent rows. Therefore, in this aspect, a good display quality can be obtained.

In another aspect according to the present invention, a liquid crystal display apparatus which utilizes an LCD having a plurality of row electrodes and a plurality of column electrodes which intersect to each other orthogonally comprises: row driver means for driving the plurality of row electrodes with driving voltages according to a predetermined function; column driver means for driving the plurality of column electrodes with driving voltages according to display data and the predetermined function; and inverting means for inverting polarities of the driving voltages by the row driver means and the column driver means at every predetermined interval. In this aspect, since the polarities of the driving voltages which drive the row electrodes and the column electrodes are inverted at every predetermined interval, a drop of contrast due to imbalance of calculation results in a calculation circuit included in the column driver means, and etc. can be effectively suppressed.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
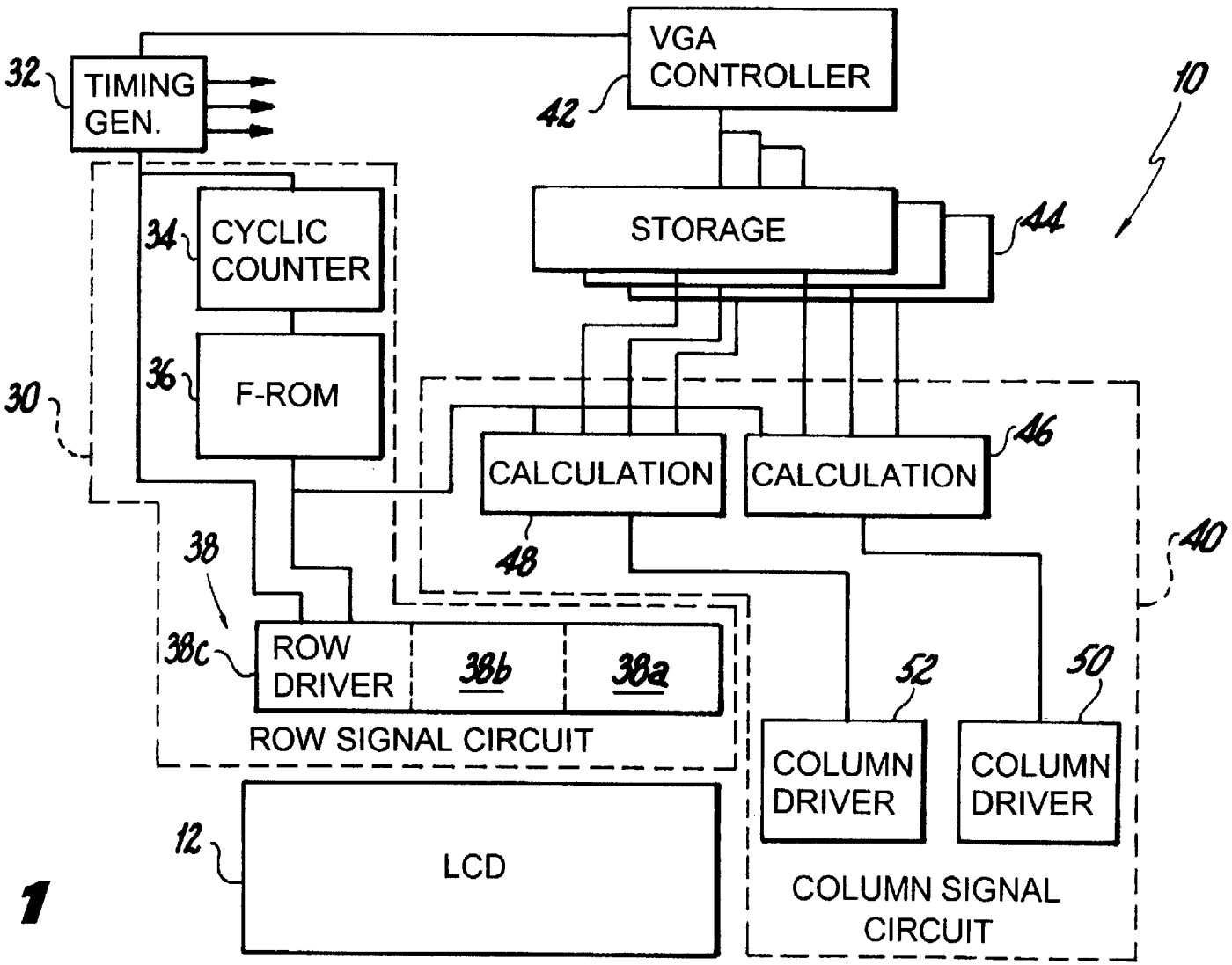
FIG. 1 is a block diagram showing one embodiment according to the present invention.
Figure 2:
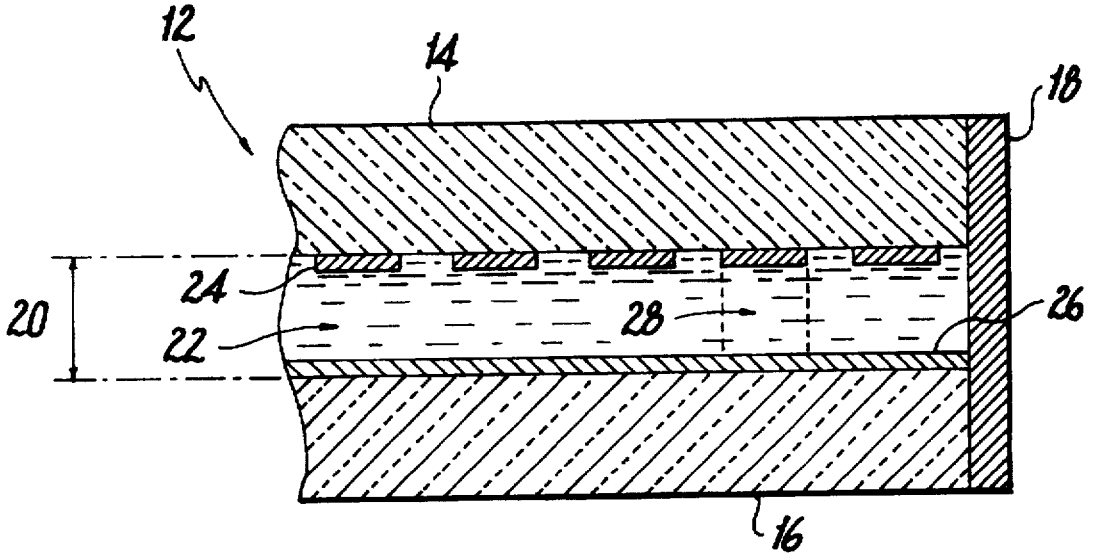
FIG. 2 is a cross-sectional illustrative view showing one example of an LCD of FIG. 1 embodiment.
Figure 3:
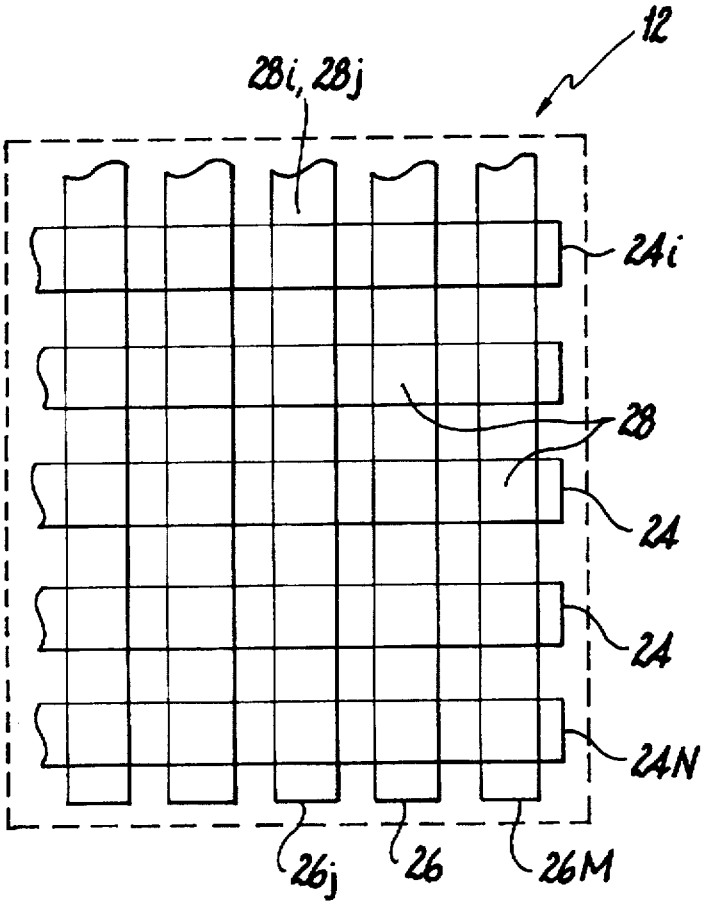
FIG. 3 is an illustrative view showing one example of an arrangement of electrodes of the LCD of FIG. 1 embodiment.

A liquid crystal display apparatus 10 of an embodiment shown in FIG. 1 includes an LCD 12. The LCD 12 is a TN type, STN type or the like and capable of fitting for the new simple matrix drive system. As shown in FIG. 2, the LCD 12 includes glass plates 14 and 16 which are arranged in parallel with each other with a predetermined gap, and a surround of the glass plate 14 and 16 is sealed by a seal member 18, whereby a sealed cell having an air gap 20 is constructed. A liquid crystal material 22 is sealed in the air gap 20. On inner surfaces, for example, of the glass plates 14 and 16, a large number of row electrodes 24 and a large number of column electrodes 26 are respectively formed. Therefore, a pixel 28 is formed at a position where each of the row electrodes 24 and each of the column electrodes 26 are intersect to each other. Thus, an N×M matrix wherein pixels 28 are arranged in a matrix as shown in FIG. 3 is constructed. In addition, specific structure of such an LCD is disclosed in the previously recited Japanese Patent Laying-Open Gazette No. 5-100642, and the same is not the gist of the present invention, and therefore, a description in more detail is omitted here.

In addition, in FIG. 1 embodiment, column electrodes having odd numbers are withdrawn from an upper side, for example, of the LCD 12 so as to form a first column electrode group, and column electrodes having even numbers are withdrawn from a lower side, for example, of LCD 12 so as to construct a second column electrode group. Then, all the row electrodes 24 which are withdrawn from a left side, for example, of the LCD 12 are divided into three, for example, row electrode groups. The row electrodes 24 (FIG. 3) of the LCD 12 are driven by a row signal circuit 30, and the column electrodes 24 (FIG. 3) are driven by a column signal circuit 40.

Figure 4:
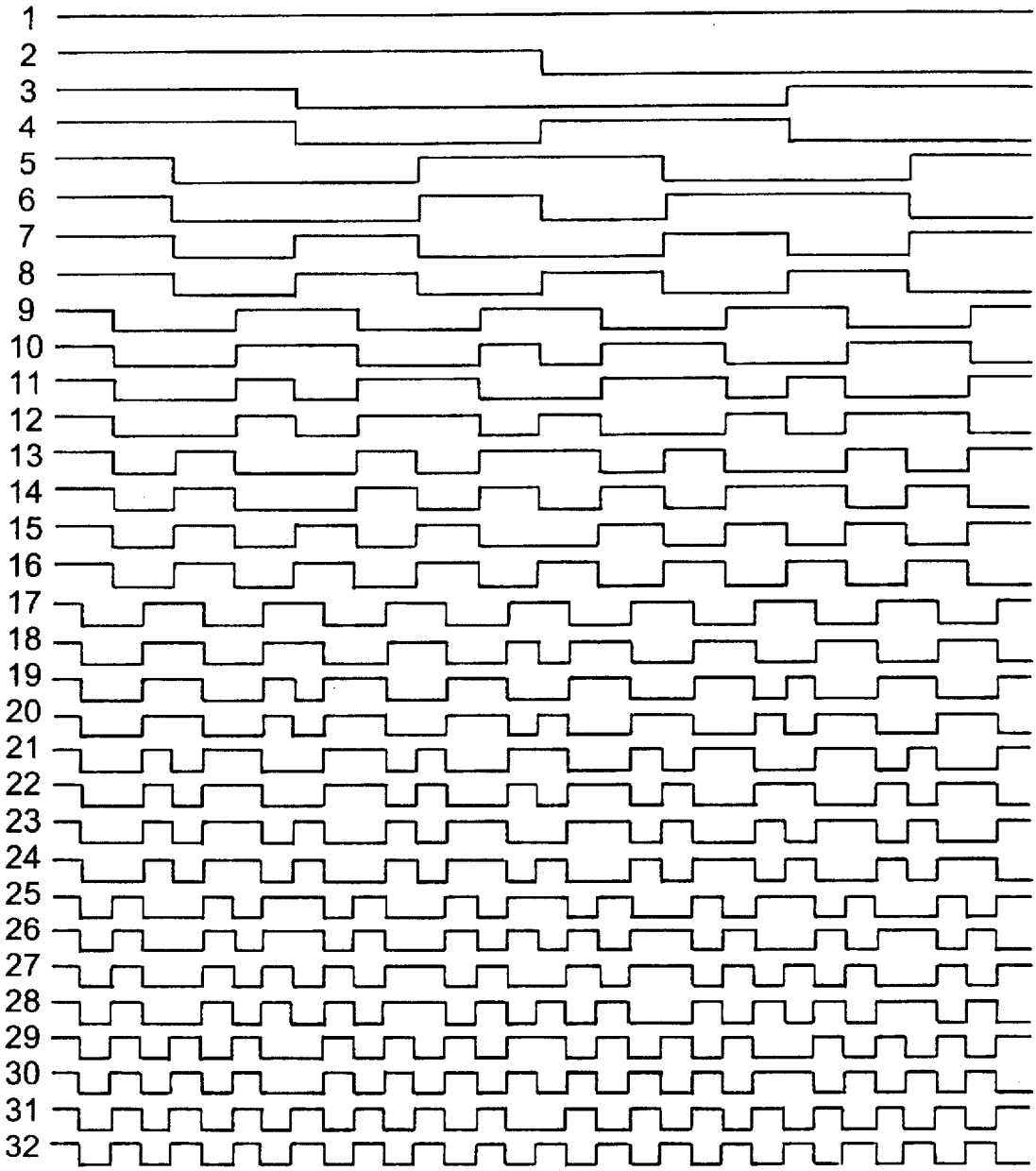
FIG. 4 is a wave-form chart showing Walsh function which is one example of a function outputted from a function ROM of FIG. 1 embodiment.

The row signal circuit 30 for driving the row electrodes 24 includes a cyclic counter which receives a clock from a timing generator 32. The cyclic counter 34 is constructed by a shift register, for example. The number of bits of the shift register is determined according to the number of row electrodes 24 of the LCD 12. In one example in which Walsh function shown in FIG. 4 is utilized, the cyclic counter 34 is constructed by a 32-nary shift register. Count value data of the cyclic counter 34 is applied to a function ROM (hereinafter, simply called as "F-ROM") 36 as a bit-parallel signal. The F-ROM 36 generates a function such as Walsh function, Rademacher function, Hadamard function or the like which can be fit for the orthonormal matrix, in accordance with the count value data from the cyclic counter 34. One example a set of Walsh functions are shown in FIG. 4. The Walsh functions come in complete sets of $2^s$ orthonormal functions, each having $2^s$ equal time intervals per period with a value of either "+1" or "−1" during each time interval. An example of 32 Walsh functions (s=5) is given in FIG. 4 for one complete period. Then, by utilizing Walsh functions, row electrode driving voltages applied to the row electrode of the LCD 12 and column electrode driving voltages applied to the column electrodes can be determined.

An information matrix I represents desired information to be displayed on the LCD 12, whose elements $I_{i,j}$ correspond to desired state of pixels on row i and column j. $I_{i,j}=+1$ is selected for a nonselect or "off" pixel and $I_{i,j}=-1$ is selected for a select or "on" pixel. Each matrix row i is driven with periodic orthonormal row signal Fi(t). If the voltage applied to the j-th column at a time of t, Gj(t) is proportional to scalar product of the j-th column vector of the information matrix and vector represented by the voltage applied to each of the N rows at a time Fi(t), that is, the voltage Gj(t) is represented by the following equation (1), an rms voltage across the pixels have the maximum selection ratio $[(\sqrt{N}+1)/(\sqrt{N}-1)]^{1/2}$. In general, the column voltage at any time is determined by the collective information state of all the pixels in the column.

$$Gj(t)=\frac{1}{\sqrt{N}}\sum_{i=1}^{N} I_{i,j}Fi(t) \tag{1}$$

As described above, the Walsh functions come in complete sets of $2^s$ orthonormal functions, each having $2^s$ equal time intervals per period with a value of either "+1" or "−1" during each time interval. Therefore, it is convenient to define a matrix A of the LCD 12 having N rows and M (=$2^s$) columns, which is derived from the Walsh functions. Then, the row electrode driving voltages are obtained from rows of the matrix A by multiplying the same by a constant F.

If the constant F is defined in accordance with the following equation (2), it is possible to normalize all row electrode driving voltages by the nonselect rms voltage.

$$F=\frac{\sqrt{N}}{2(\sqrt{N-1})} \tag{2}$$

where, N is the number of row electrodes.

Then, with the bilevel, multi-interval row electrodes driving voltages, the column electrode driving voltage for an arbitrary column electrode 26*j* at k-th time during the interval Δ tk can be given by the following equation (3).

$$Gj(\Delta tk) = \frac{F}{\sqrt{N}} \sum_{i=1}^{N} Ii,jAi(\Delta tk) \quad (3)$$

where, the Ai(Δ tk)=30 1 or −1 are segments of the matrix A for row i and the time interval Δ tk.

A product in the equation (3) operating on +1 and 31 1 is equivalent to an exclusive-OR (X-OR) logical operation, and thus, summation expressed as is the number of matching Dj(Δ tk) between segments in the j-th column of the information matrix I and corresponding elements in the k-th column of the matrix A. Therefore, the equation (3) can be converted into the following equation (4).

$$Gi(\Delta tk) = \frac{F}{\sqrt{N}} [2Dj(\Delta tk) - N] \quad (4)$$

Then, for the X-OR operation, values of the elements of the matrix I and the matrix A can be replaced by "1" and "0" in the digital circuit for the X-OR.

Furthermore, a result of the above described equation (4) becomes to be an analog value, but there is no problem even if the same is approximated to any one of predetermined small number of voltage values.

In addition, the Walsh function and the row electrode driving and the column electrode driving according to the Walsh function is described in detail in the previously recited U.S. patent application Ser. No. 07/678,736 or Japanese Patent Laying-Open Gazette No. 5-100642. Therefore, the description will be incorporated in this specification by reference.

Thus, row drivers 38*a*, 38*b* and 38*c* individually and simultaneously drive respective one row electrode included in each of a plurality (n: in this embodiment, 3) of row electrode groups of the row electrodes 24 of the LCD 12 in accordance with the functions shown in FIG. 4 and generated by the F-ROM 36. In a case where the row electrodes of the LCD 12 are divided into a plurality of row electrode groups, the row drivers 38*a*, 38*a* and 38*c* apply driving voltages of predetermined values in accordance with the functions from the F-ROM 36, for example, the Walsh functions to the selected row electrode within the respective electrode groups. The row drivers 38*a*, 38*b* and 38*c* apply zero voltages to row electrodes not selected within the respective row electrode groups. In a case where the plurality (N) of row electrodes 241–24N are divided into a plurality (L) of row electrode groups, a plurality (L) of row vectors of the Walsh functions which are not duplicated to each other are withdrawn to be utilized for the matrix A of the equation (3). In a case where the row electrodes 241–24N are divided into three row electrode groups, three functions a, b and c (FIG. 7) having the least common multiple of "32" of the intervals are selected. For each of 32 intervals, "+1" or "1" is assigned. Therefore, the row drivers 38*a*, 38*b* and 38*c* apply voltages corresponding to "+1" and "−1", and zero voltage to respective row electrodes 241–24N. The cyclic counter 34 applies the count value data to the F-ROM 36 to designate the period of the function.

On the other hand, a video signal is applied to a VGA controller 42. The VGA controller 42 produces display data of one frame, for example, on the basis of the video signal so as to apply the same to a storage 44. The display data from the storage 44 is applied to first and second calculation circuits 46 and 48 which are included in the column signal circuit 40. The calculation circuits 46 and 48 receive the display data from the storage 44 and the functions from the F-ROM 36. Therefore, the calculation circuits 46 and 48 calculate driving voltages being fit for the display data in accordance with the function data from the F-ROM 36. In a case of the Walsh function, the products of the segment of the matrix A of the equation (3) and the segment of the vector of the information to be displayed is calculated by the calculation circuits 46 and 48, and a plural number of voltage value data are applied from the calculation circuits 46 and 48 to corresponding ones of column drivers 50 and 52. As described in the above, in this embodiment shown, the column electrodes 26 of the LCD 12 are divided into a first column electrode group including the column electrodes of the odd number and a second column electrode group including the column electrodes of the even number, and the first column driver 50 drive the column electrodes includes in the first column electrode group, and the second column driver 52 drives column electrodes includes in the second column electrode group. That is, the column drivers drive all the column electrodes in cooperation with each other. Therefore, the voltage value data from the first calculation circuit 46 is applied to the first column driver 50, and the voltage value data from the second calculation circuit 48 is applied to the second column driver 52.

Figure 5:
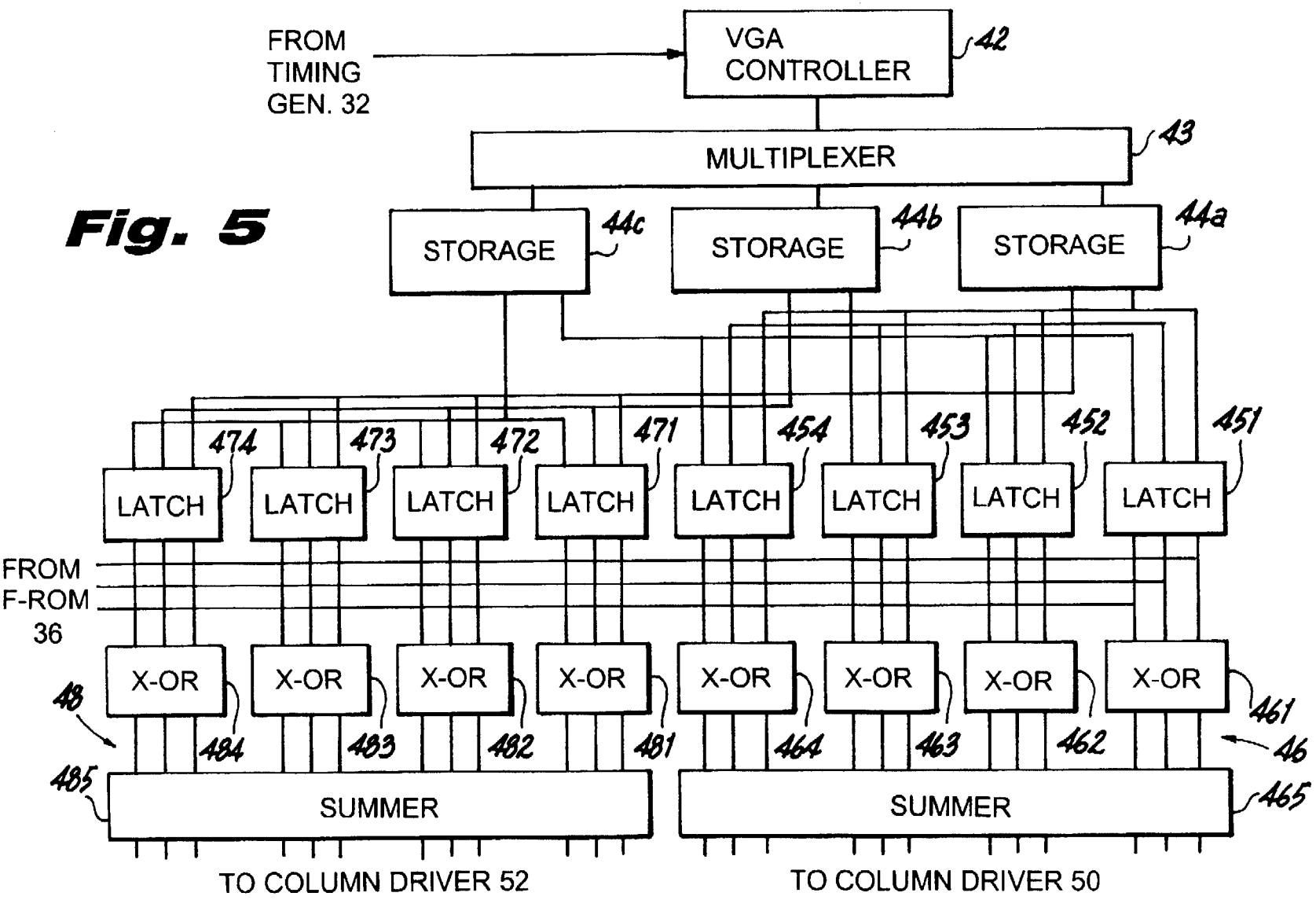
FIG. 5 is a block diagram showing in detail a major portion of FIG. 1 embodiment.

In more detail with referring to FIG. 5, the display data from the VGA controller 42 is distributed to three storages 44*a*, 44*b* and 44*c* by a data distributor or multiplexer 43. Since three row drivers 38*a*, 38*b* and 38*c* are utilized in FIG. 1 embodiment, the three storages 44*a*, 44*b* and 44*c* are utilized. That is, if a plurality (n) of row drivers are utilized, the plurality (n) of storages which correspond to the number of rows which are simultaneously driven by the row drivers are utilized. Then, the three storages 44*a*–44*c* may be separate storages, or separate regions within a single storage device. Furthermore, the distribution of the display data may be processed in accordance with a program in a software manner instead of the multiplexer 43. Then, the display data is a 8-bit parallel signal. On the other hand, 4 bits are utilized for one pixel. Therefore, from the VGA controller 42, i.e. the multiplexer 43, the display data for 2 pixels are applied to the storage 44*a*–44*c* at once for each row.

The storages 44*a*–44*c* store the display data of one frame for each row as a whole. In a case where the LCD 12 (FIG. 1) includes a plurality (M) of column electrodes 26, the display data for M pixels constituting one row or line are stored in one of the storages 44*a*, 44*b* and 44*c*. Then, if there are provided with a plurality (N) of row electrodes 241–24N and the row electrodes 241–24N are divided into three row electrode groups, the display data for pixels for N/3 rows are individually stored in the storage 44*a*–44*c*. More specifically, the display data for first, fourth, seventh, . . . , (N-2)-th rows are stored in the storage 44*a*, the display data equal to second, fifth, eighth, . . . , (N-1)-th rows are stored in the storage 44*b*, and the display data for third, sixth, ninth, . . . , N-th rows are stored in the storage 44*c*.

In more detail, in FIG. 1 embodiment, the row drivers 38*a*, 38*b* and 38*c* are connected to the respective row electrodes 24 of the LCD 12 in a manner that the row drivers 38*a*, 38*b* and 38*c* individually and simultaneously drive or scan the first, second and third rows at a first timing, and at a next timing, the row drivers 38*a*, 38*b* and 38*c* individually and simultaneously drive or scan the fourth, the fifth and sixth rows, and the same rule is applied correspondingly to the following. Therefore, the respective storages 44*a*–44*c* store the display data such that the display data of three rows at respective timings can be simultaneously read-out.

However, in a case where a different connection between the row drivers 38*a*–38*c* and the row electrodes 24 is adopted, the display data stored in the respective storages 44a–44c may be different from that of the above described case. In a case where the row drivers 38a, 38b and 38c are connected to the row electrodes 24 in a manner that the row drivers 38a, 38b and 38c scan or drive first, (N/3+1)-th and (2N/3+1)-th rows at a first timing, and at a next timing, second, (N/3+2)-th and (2N/3+2)-th rows are scanned, and the same rule is applied correspondingly to the following, the display data of the first, second, . . . , (N/3)-th rows are stored in the storage 44a, the display data of the (N/3+1)-th, (N/3+2)-th, . . . , (2N/3)-th rows are stored in the storage 44b, and the display data of the (2N/3+1)-th, (2N/3+2)-th, . . . , N-th rows are stored in the storage 44c.

The display data of 4 bits for one pixel from the storages 44a–44c are latched by latches 451, 452, 453 and 454, and latches 471, 472, 473 and 474, respectively, bit by bit. That is, the display data for one pixel is stored by the latches 451–454, and the display data for one pixel is latched by the latches 471–474. Display data of the column electrodes which are simultaneously driven are thus stored in the latch 451–454 and latches 471–474, and therefore, the calculation circuits 46 and 48 simultaneously process the latched display data to determine the voltage values for driving the column electrodes. As described above, the display data is 4 bits per pixel, the display data of 8 bits are read-out from the storages 44a–44c, and therefore, the display data for two pixels can be read-out at once from the storages 44a–44c. Accordingly, if one display data is utilized for the display data for the first column electrode group (odd number column electrode) and the other is utilized for the display data for the second column electrode group (even number column electrode), it is possible to simultaneously implement the calculations of the voltage values to be applied to the first and second column drivers 50 and 52.

Then, in a case of the Walsh function, the equation (3) can be replaced by the equation (4) in which the calculation is performed by "+1" and "−1", and therefore, in the calculation circuits 46 and 48, only the X-OR and the normalization by a voltage for a whole frame time are required. Therefore, the X-OR of the value of the function read-out from the F-ROM 36 and the display data latched by the latches 451–454 are processed by X-OR circuits 461–464, and results of the X-OR are summed by a summer 465, whereby the number of mismatching can be obtained. In a similar manner, the X-OR of the value of the function read-out from the F-ROM 36 and the display data latched by the latches 471–474 are processed by X-OR circuits 481–484, and results of the X-OR are summed by a summer 485, whereby the number of mismatching can be obtained. The data of 3 bits thus obtained are converted into a voltage at any one of 3–9 levels, for example, by the first and second column drivers 50 and 52, and the voltage is applied to the column electrodes to the LCD 12 as the column electrode driving voltage.

In addition, the smaller number of the voltage levels, the larger number of mismatching, and the larger number of the voltage levels, the smaller number of mismatching. In the former case, the conversion into the voltage value can be simply performed in the column drivers 50 and 52. However, in the latter case, the accuracy of the voltage becomes good while it takes a long time for the conversion into the voltage value. Therefore, by taking the both cases into consideration, the number of voltage levels can be determined. However, it is desirable that the number of voltage levels is smaller as possible within a range in which no influence is affected to the display on the LCD 12.

Thus, in accordance with the embodiment shown in FIG. 1 and FIG. 5, in calculating the driving voltages for the respective column electrodes, the column electrodes are divided into a plurality of column electrode groups, and the driving voltage are calculated for each of the column electrode groups, and therefore, even if the number of pixels, i.e. the number of column electrodes of the LCD 12 becomes large, burdens in the calculation circuits 46 and 48 become small. In other words, even if the number of column electrodes of the LCD 12 becomes large, it is not required to use a calculation device as a microcomputer or DSP having rapid calculation speed as each of the calculation circuits 46 and 48, and therefore, it is possible to make the liquid crystal display apparatus 10 cheap as a whole.

Figure 7:
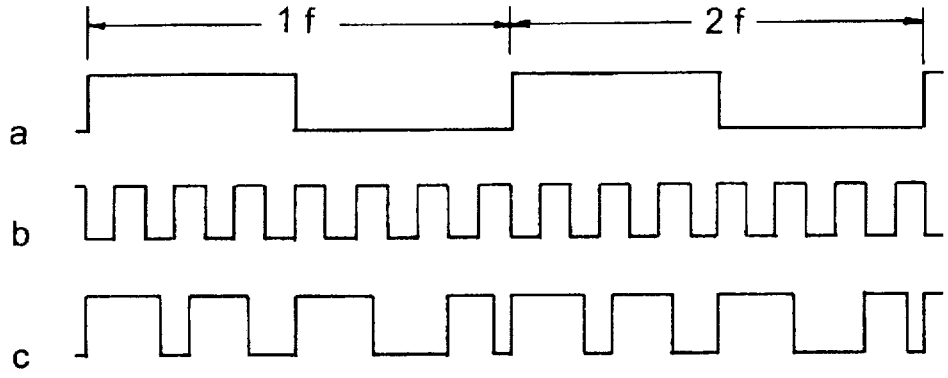
FIG. 7–FIG. 9 are wave-form charts showing an operation of FIG. 6 embodiment.

As described above, in FIG. 1 embodiment, the functions a, b and c as shown in FIG. 7, for example, are selected from the Walsh functions, for example, which are outputted from the F-ROM 36, and in accordance with the functions, the row drivers 38a, 38b and 38c individually and simultaneously drive the plurality of row electrodes of the LCD 12. In a case where the functions a, b and c shown in FIG. 7 are selected, the driving voltages having the same wave-forms are applied to the plurality of row electrodes at every predetermined interval, and therefore, fundamental frequencies of the driving voltages for the respective row electrodes become to be fixed. Therefore, a difference of the contrast can be observed on the LCD 12, due to the difference between the fundamental frequencies of the driving voltages for adjacent row electrodes. For example, the fundamental frequencies of the driving voltages for the row electrodes which are driven by fundamental wave-form having low frequencies shown by the numerals "1", "3" and etc. in FIG. 4, becomes low in spite of the column electrode driving voltages. Therefore, in such the rows, thin colors are represented in comparison with another rows having higher fundamental frequencies. This is a cause by which a shade of color is appeared on the LCD 12 even though no gradation display is required, and therefore, a display quality is largely lowered.

Figure 6:
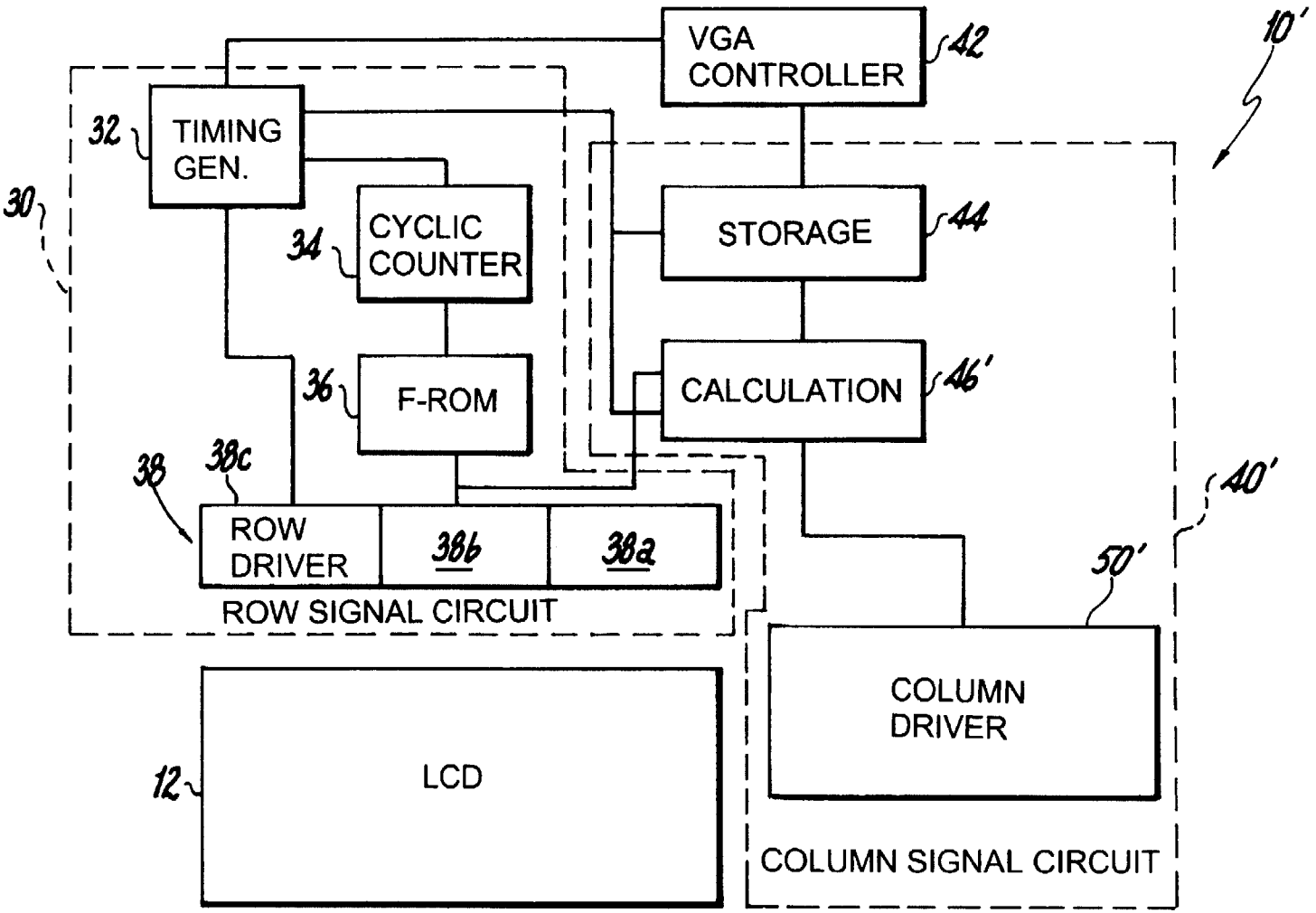
FIG. 6 is a block diagram showing another embodiment according to the present invention.
Figure 8:
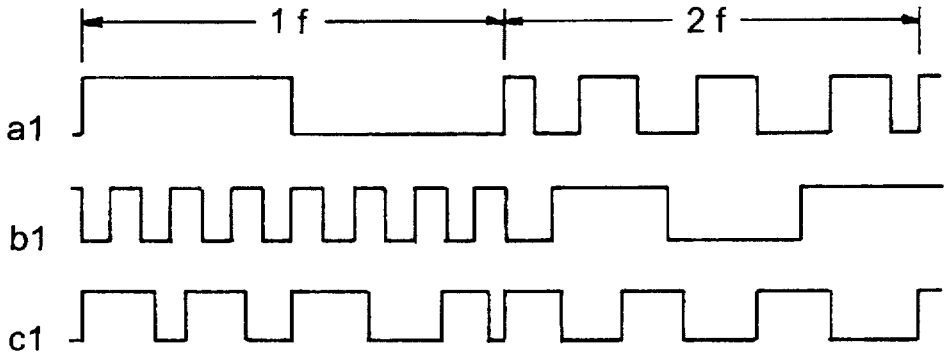

Therefore, in an embodiment shown in FIG. 6, different functions as shown in FIG. 8, for example, are set in the F-ROM 36. Then, the different functions are changed-over in accordance with the count value data from the cyclic counter 34 (or a changing signal from the timing generator 32). For example, in a case where the driving voltage according to the function a1 shown in FIG. 8 is applied to one row electrode of the LCD 12, at a given interval, the function a1 during the interval designated by **1*f* in FIG. 8 is outputted from the F-ROM 36, and when another interval is designated by the cyclic counter 34, the function a1 during the interval designated by 2*f* in FIG. 8 is selected. In a similar manner, a function b1 is to be utilized, at a given interval, a wave-form shown during the interval designated by 1*f* in FIG. 8 is utilized, and at another interval, another function during the interval shown by 2*f* in FIG. 8 is utilized. The same rule can be correspondingly applied to a function c1 of FIG. 8**.

In FIG. 8, an example where a function by which a frequency of the driving voltage applied to one row electrodes becomes low and a function by which the frequency becomes high are combined with each other is illustrated, but, arbitrary different functions can be combined with each other.

Then, as described above, a calculation circuit 46' determines the driving voltage for the column electrode by evaluating the X-OR of the selected function and the display data, and the sum of the results of the X-OR, and therefore, a voltage averaging method is not destroyed.

In addition, as the different functions, different functions both included in the Walsh function may be selected;

however, another function such as Rademacher function, Hadamard function or the like may be combined with the Walsh function.

Figure 9:
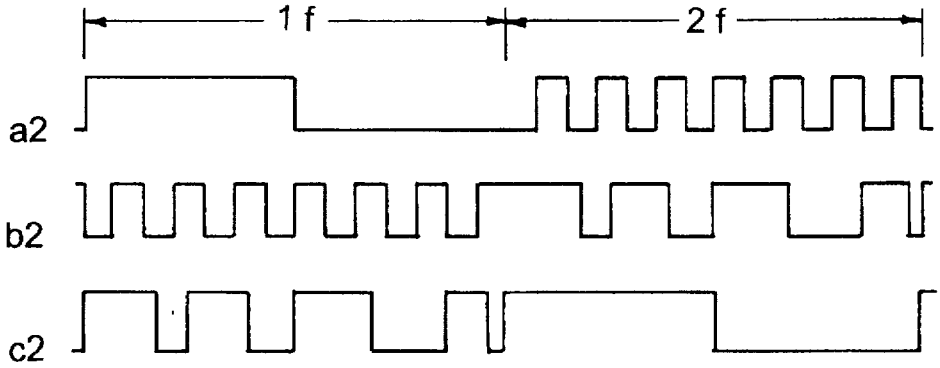

Furthermore, in an embodiment shown in FIG. 8, the function which determines the driving voltages which are inherently applied to respective row electrodes of the LCD 12 are changed at every predetermined interval; however, such a change of the function may be performed for each row electrode. For example, as shown in FIG. 9, if three row electrodes are scanned or driven by utilizing functions a2, b2 and c2 during a given interval 1*f*, the functions b2, c2 and a2 are utilized for scanning or driving the same three row electrodes during a next interval 2*f*. That is, in FIG. 9 embodiment, the function which was utilized for scanning or driving one row electrode during one interval is utilized for scanning or driving another row electrode during another interval.

In a case of FIG. 9 embodiment, it is not necessary to change the functions which are set in the F-ROM 36, and functions which become the base of the driving voltage applied to a specific row electrode may be changed-over in accordance with an output of the cyclic counter 34 (or the timing generator 32). In order to changing-over the functions, it is considered that a shift register (not shown) may be provided at an output of the F-ROM 36 so that the output data (function) from the F-ROM 36 is shifted at every interval. As another method, an address of the F-ROM 36 which is designated by the cyclic counter 34 is changed at every interval. In such a case, an address changing circuit (not shown) may be provided at an output of the cyclic counter 34.

In addition, in FIG. 6 embodiment, one storage 44, and one column signal circuit 40' which includes one calculation circuit 46' and one column driver 50' are utilized; however, as similar to FIG. 1 embodiment, a plurality of storages may be utilized, and the column signal circuit 40' may includes a plurality of calculation circuits and a plurality of column drivers.

In the embodiment shown in FIG. 6 (and FIG. 8 and FIG. 9), since the function which becomes the base of the driving voltage applied to respective one row electrode is changed at every predetermined interval, the fundamental frequencies of the driving voltages of the respective row electrodes are not fixed, and therefore, the difference of the contrast due to the difference of the fundamental frequencies of the adjacent rows is reduced, and therefore, it was possible to improve the display quality.

Figure 10:
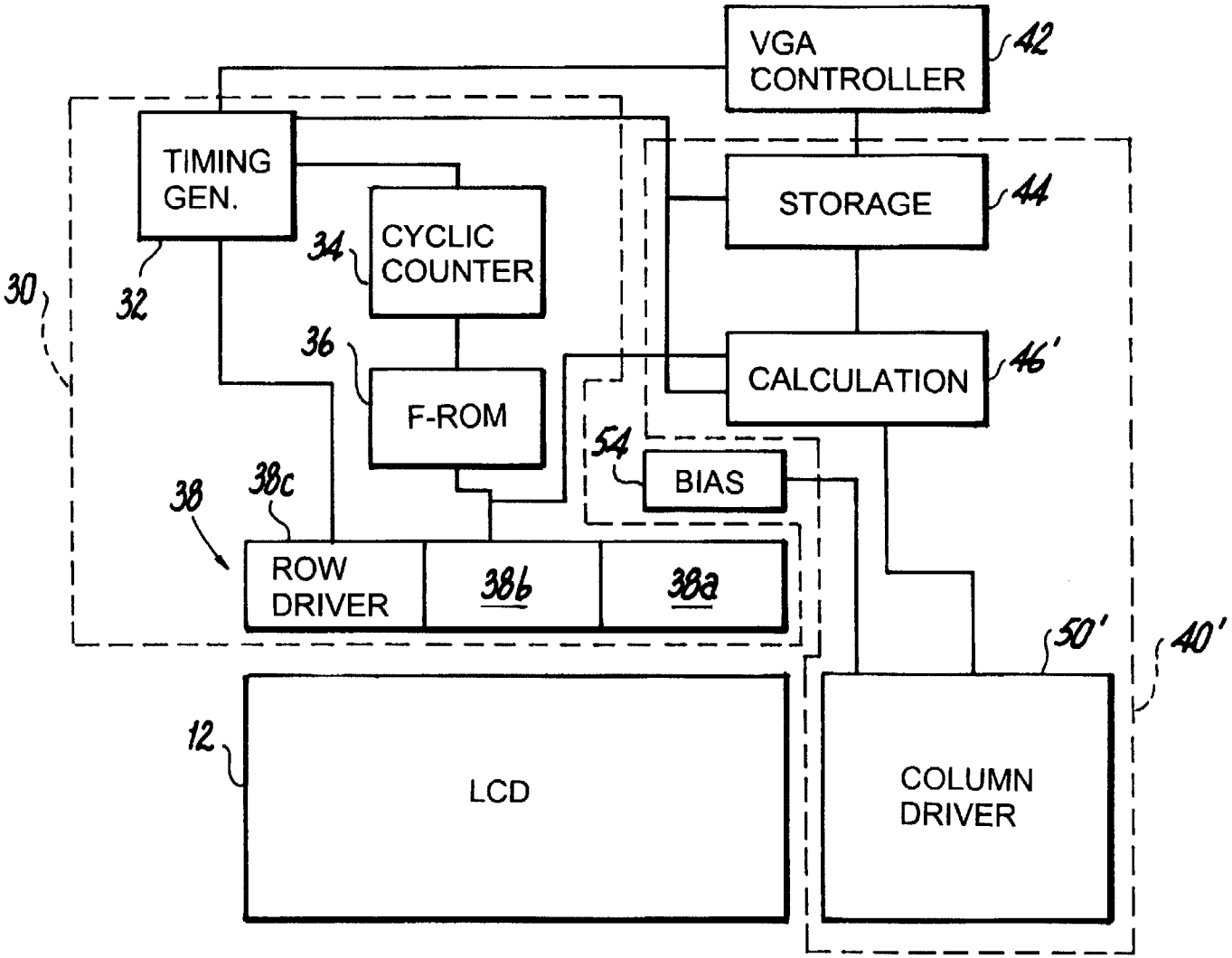
FIG. 10 is a block diagram showing another embodiment according to the present invention.

As similar to FIG. 6 embodiment, FIG. 10 embodiment is and embodiment for improving a drop of the display quality which was observed in FIG. 1 embodiment, and FIG. 10 embodiment is provided with a bias circuit 54. The bias circuit 54 applies bias voltages to the row driver 38 and the column driver 50' to invert polarities of the row electrode driving voltages and column electrode driving voltages at every predetermined interval.

Figure 11:
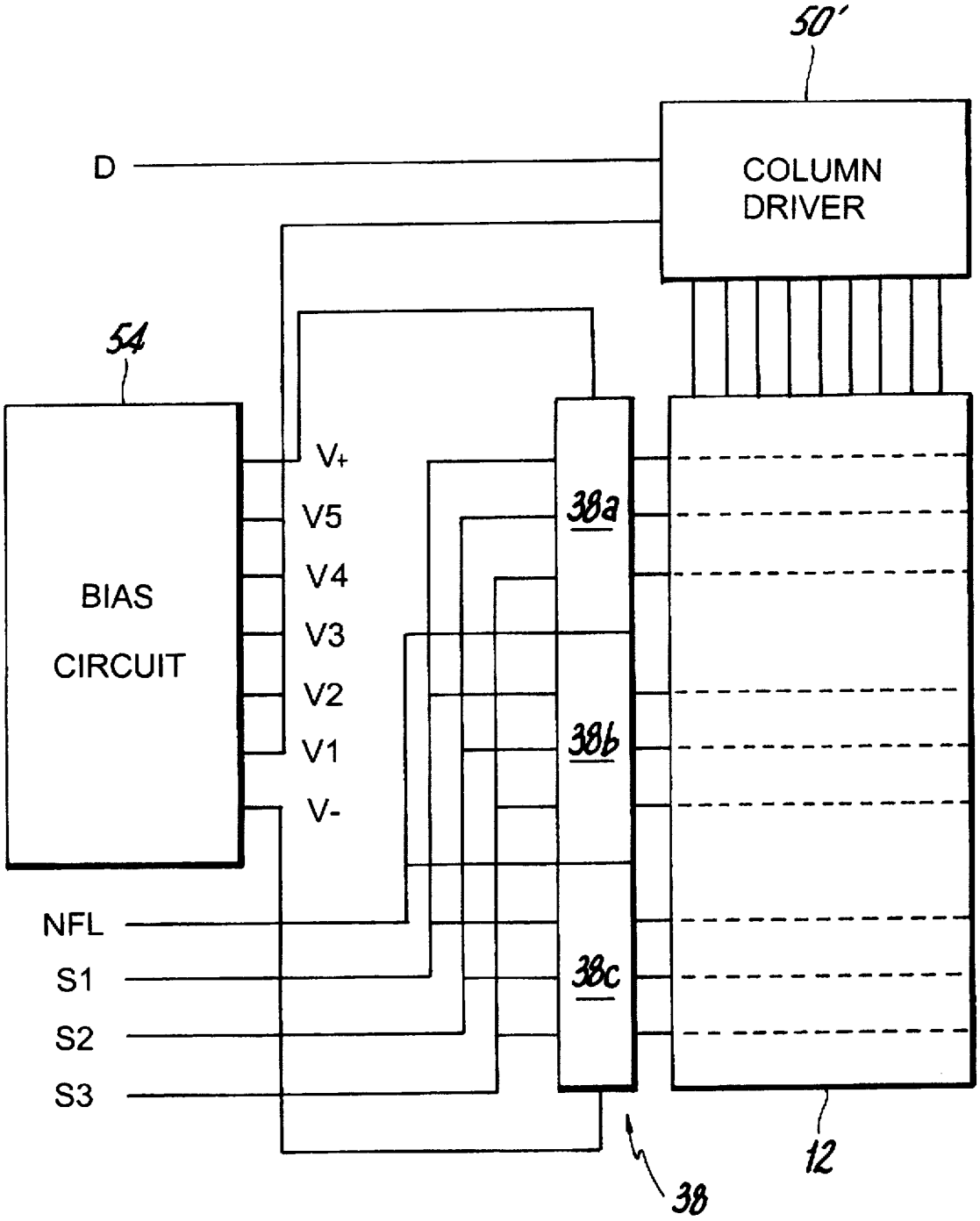
FIG. 11 is a block diagram showing in detail a major portion of FIG. 10 embodiment.

As shown in detail in FIG. 11, the bias circuit 54 applies bias voltages V+ and V− corresponding to two values of "+1" and "−" of the functions, and zero voltage as necessary to the row driver 38 (row drivers 38*a*, 38 *b* and 38*c*), and applies bias voltages V1, V2, V3, V4 and V5, and the bias voltages V+ and V− as necessary to the column driver 50'. In addition, in FIG. 11, the function outputs are applied to the row driver 38 and the column driver 50' by three signal lines S1, S2 and S3. Then, in this embodiment shown, three row electrodes of the LCD 12 are individually and simultaneously driven by the row drivers 38*a*, 38*b* and 38*c*. At that time, the bias voltage V+ or V− is applied to the row drivers 38*a*–38*c* from the bias circuit 54 at every interval. In addition, the zero voltage is applied for each of remaining row electrodes; however, the bias voltage V3 (zero voltage) which is generated by the bias circuit 54 may be utilized as the zero voltage.

On the other hand, the display data from the storage 44 is applied to the calculation circuit 46', and the information vector from the calculation circuit 46 is applied to the column driver 50' as the 3-bit data. In the column driver 50', any one of the bias voltage V1–V5 which are applied from the bias circuit 54 is selected in accordance with a magnitude of the information vector to apply the same to the column electrode of the LCD 12.

In addition, in FIG. 11 embodiment, the respective bias voltages are set in a manner that the bias voltages V4, V5 and V+ are in symmetry to the bias voltages V3, V2, V1 and V− approximately at a center of the bias voltage V3. Such a method for generating the bias voltages is determined through a laboratory work by the inventors. However, such symmetrization is not required necessarily. Furthermore, the number of the bias voltages is seven in FIG. 11 embodiment, but the number may be larger or smaller than seven.

In addition, as a cause of the above described drop of the display quality, the imbalance of the calculation results in the calculation circuit 46' which occurs in a case where the video signal is formed by the repetitions of a constant pattern or a specific pattern, an error which occurs in a case where the calculation result of the calculation circuit 46' is converted into the voltage at any one of the small number levels or its accumulation, or the imbalance of the driving voltages of the row driver and the column driver or its accumulation can be considered. Therefore, in the new simple matrix drive system wherein the voltages applied to the LCD 12 are theoretically averaged, by changing the polarities of the driving voltages of the row electrodes and the column electrodes by applying the bias voltages, it was possible to improve a drop of the display quality due to the above described cause.

Then, in view of the cancellation of the above described cause, if the display data is inverted, the bias voltages preferably have the above described symmetrization, but in view of the dispersion of the driving voltages rather than the cancellation, the bias voltages are not required to have the symmetrization.

Figure 12:
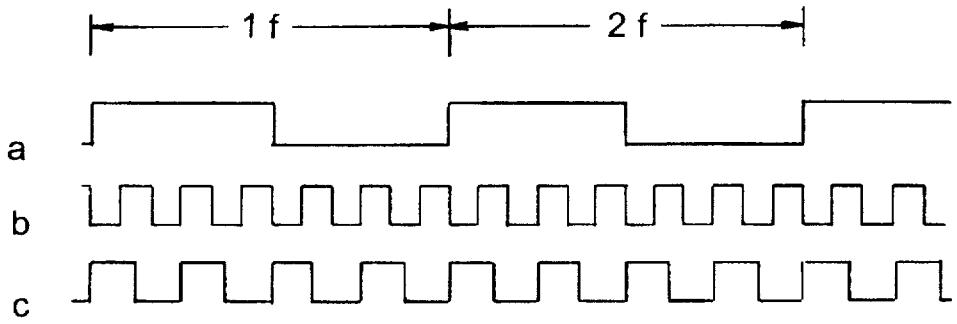
FIG. 12–FIG. 14 are wave-form charts showing an operation of FIG. 10 embodiment.
Figure 13:
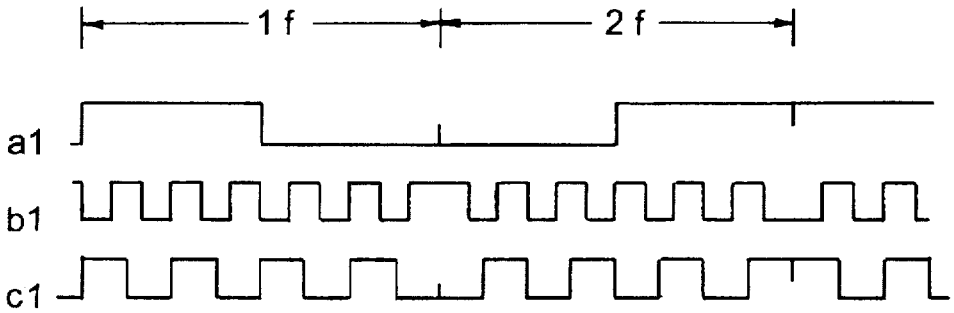

In FIG. 10 embodiment, the calculation circuit 46' utilizes the voltage values according to the two-value function described above, and calculates the X-OR on the basis of the function from the F-ROM 36, and the sum of the results of the X-OR. Therefore, by inverting an output of the two-value function from the F-ROM 36 at every predetermined interval by the cyclic counter 34, the calculation result becomes to have an inverted value, and therefore, if the bias voltages from the bias circuit 54 have the above described symmetrization, the polarity of the driving voltage applied to the column electrodes of the LCD 12 from the column driver 50' becomes to be inverted at every predetermined interval. That is, in accordance with the inverting signal at every predetermined interval from the cyclic counter 34, the function from the F-ROM 36 becomes to have the polarity which is inverted at every predetermined interval (frame) as shown in FIG. 13. In addition, FIG. 12 shows the functions a, b and c utilized in FIG. 1 embodiment, as similar to FIG. 7. However, the function may be inverted at predetermined interval that is integer-times the frame interval, and the inversion of the function may be performed at a time of changing of the display data.

Figure 14:
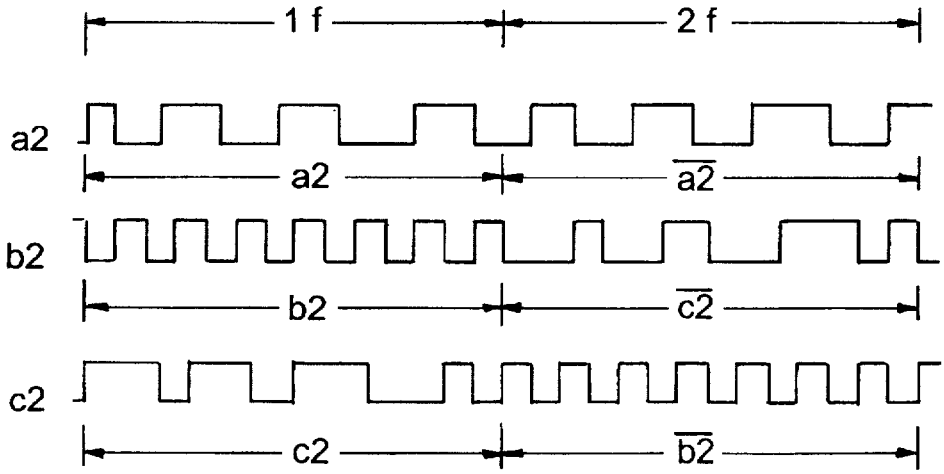

Furthermore, in inverting the function, the function read-out from the F-ROM 36 may be inverted for each row. More specifically, if the functions a2, b2 and c2 shown in FIG. 14, for example, are selected at a given interval 1*f*, at a next interval 2*f*, the functions b2 and c2 are interchanged to be utilized, whereby not only the error of a direct current component or its accumulation is reduced, but also the fundamental frequency of the driving voltage for each row electrode is not fixed, and therefore, the imbalance of the calculation result and the error accumulation can be more effectively canceled.

Furthermore, if only the inversion of the polarities of the driving voltages for the row electrodes and the column electrodes is required, bias inverting circuits (not shown) may be provided in the row driver 38 and the column driver 50' and the bias voltage may be inverted in spite of the function from the F-ROM 36.

In addition, in FIG. 10 embodiment, one storage 44, and one column signal circuit 40' which includes one calculation circuit 46' and one column driver 50' are utilized; however, as similar to FIG. 1 embodiment, a plurality of storages may be utilized, and the column signal circuit 40' may include a plurality of calculation circuits and a plurality of column drivers.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A liquid crystal display apparatus utilizing an LCD which includes a plurality (N) of row electrodes and a plurality (M) of column electrodes, said N and M being integers, and said row electrodes and said column electrodes intersecting orthogonally to each other, said apparatus comprising:

row driver means for individually and simultaneously driving a plurality (n) of row electrodes of said plurality (N) of row electrodes with a voltage in accordance with an orthogonal function, said n being less than said N;

display data outputting means for outputting display data;

a plurality (n) of storages for individually storing said display data in correspondence to said plurality (n) of row electrodes to be simultaneously driven by said row driver means; and column driver means for driving said plurality (M) of column electrodes with voltages calculated in accordance with display data outputted from said plurality (n) of storages and said orthogonal function.

2. An apparatus according to claim 1, wherein said column driver means includes a plurality (m) of column drivers driving said plurality (M) of column electrodes in cooperation with each other, said m being less than said M.

3. An apparatus according to claim 1, wherein said column driver means includes a plurality (m) of calculation means for receiving display data from said plurality (n) of storages, said plurality (m) calculation means performing the calculation of data of voltage values for driving said column electrodes in accordance with said display data and said predetermined function so as to apply said data of voltage value to respective ones of said plurality of column drivers.

4. A liquid crystal display apparatus for displaying data on a frame-by-frame basis utilizing an LCD which includes a plurality of row electrodes and a plurality of column electrodes, said row electrodes and said column electrodes intersecting orthogonally to each other, said apparatus comprising:

function outputting means for outputting a plurality of orthogonal functions which are different from each other at every frame;

row driver means for simultaneously driving said plurality of row electrodes, each with voltages determined in accordance with a different orthogonal function of said plurality of orthogonal functions.

5. An apparatus according to claim 4, wherein said function outputting means outputs said different orthogonal functions, a respective one of which orthogonal functions is inherently assigned to a respective one of said row electrodes at every frame.

6. An apparatus according to claim 4, wherein said function outputting means outputs said different orthogonal functions by exchanging an orthogonal function with another orthogonal function.

7. An apparatus according to claim 4, wherein said LCD includes a plurality (N) of row electrodes and a plurality (M) of column electrodes, and said row driver means individually and simultaneously drives a plurality (n) of row electrodes of said plurality (N) of row electrodes with voltages determined in accordance with said different orthogonal functions, said n being less than said N and said apparatus further comprising display data outputting means for outputting display data; and a plurality (n) of storages for individually storing said display data for each of said rows corresponding to the plurality (n) of row electrodes to be simultaneously driven by said row driver means, wherein said column driver means drives said plurality (M) of column electrodes with said voltages determined in accordance with the display data outputted from said plurality (n) of storages and said different orthogonal functions.

8. A liquid crystal display apparatus for displaying data on a frame-by-frame basis utilizing an LCD which includes a plurality of row electrodes and a plurality of column electrodes, said row electrodes and said column electrodes intersecting orthogonally to each other, said apparatus comprising:

row driver means for simultaneously driving said plurality of row electrodes with row voltages determined in accordance with an orthogonal function;

column driver means for simultaneously driving said plurality of column electrodes with column voltages determined in accordance with said orthogonal function; and inverting means for inverting the polarities of said row voltages by said row driver means and said column voltages by said column driver means at every frame.

9. An apparatus according to claim 8, wherein said inverting means outputs a plurality of voltage values in a symmetrical manner having a center of a specific voltage value.

10. An apparatus according to claim 8, wherein said inverting means includes bias voltage generating means for applying said plurality of voltage values to said row driver means and said column driver means.

11. An apparatus according to claim 8, further comprising function generating means for generating said predetermined function, said function generating means generating different functions at every said predetermined interval, whereby said inverting means inverts the polarities of said row voltages and said column voltages.

12. An apparatus according to claim 8, wherein said LCD includes a plurality (N) of row electrodes and a plurality (M) of column electrodes, and said row driver means individually and simultaneously drives a plurality (n) of row electrodes of said plurality (N) of row electrodes with voltages determined in accordance with said different orthogonal functions, said n being less than said N, and said apparatus further comprising display data outputting means for outputting display data; and a plurality (n) of storages for individually storing said display data for each of said rows corresponding to the plurality (n) of row electrodes to be simultaneously driven by said row driver means, wherein said column driver means drives said plurality (M) of column electrodes with said voltages determined in accordance with the display data outputted from said plurality (n) of storages and said orthogonal function.

* * * * *